United States Patent [19]

Robbins et al.

[11] 4,121,727

[45] Oct. 24, 1978

[54] VIAL CONSTRUCTION HAVING SAFETY CLOSURE

[75] Inventors: Douglas R. Robbins; Samuel B. Robbins, Jr., both of Jamestown, N.Y.

[73] Assignee: Mark IV Industries, Inc., Williamsville, N.Y.

[21] Appl. No.: 875,333

[22] Filed: Feb. 6, 1978

[51] Int. Cl.[2] ..... B65D 55/00

[52] U.S. Cl. ..... 215/211; 215/206; 215/224

[58] Field of Search ..... 215/211, 213, 214, 216, 215/225, 224, 206

[56] References Cited

U.S. PATENT DOCUMENTS

| | | | |
|---|---|---|---|
| 3,432,058 | 6/1967 | Burgess | 215/206 |
| 3,845,874 | 11/1974 | Robbins et al. | 215/214 |
| 3,896,958 | 7/1975 | Roffins et al. | 215/211 |
| 3,951,289 | 4/1976 | Landen | 215/211 |
| 3,991,895 | 11/1976 | Thornton | 215/211 |
| 4,065,017 | 12/1977 | Burton | 215/211 |

*Primary Examiner*—George T. Hall
*Attorney, Agent, or Firm*—Joseph P. Gastel

[57] ABSTRACT

A vial construction including a vial body portion, an open end on said body portion, a tapered rim surrounding said open end, a plug having an entry portion for guidance by said tapered rim, a plug engaging portion on the body portion adjacent to the tapered rim, an interference fit between the entry portion and the plug engaging portion to render the connection therebetween fluid tight, a locking ring mounted on the outside of the rim and having a flange extending over the rim toward the open end of the container, cam locking members engageable with the flange to lock the plug to the flange, and a cutaway portion on the flange to permit disengagement between the flange and the cam locking members when the plug is rotated to a predetermined circumferential position on the locking ring.

17 Claims, 6 Drawing Figures

VIAL CONSTRUCTION HAVING SAFETY CLOSURE

BACKGROUND OF THE INVENTION

The present invention relates to an improved container construction which is utilized essentially for pills, capsules or the like, and more particularly to a fluid tight construction between the plug and the container body portion.

By way of background, in recent years pill containers or vials have been made with various types of safety lock arrangements for the caps or plugs thereof for making them "child-resistant", that is, for preventing opening of such containers by children. One type of construction is shown in prior patents Nos. 3,845,874 and 3,896,958. In these prior patents an arrangement is shown which permits the cap or plug to be removed from a vial body portion only when the plug is rotated to a predetermined circumferential position on the vial body portion. In this prior construction the plug can be mounted on the vial body portion in any position, by merely pressing it into the vial, whereupon cam locking members lock the cap to the body portion of the vial. However, the prior construction did not provide fluid tight engagement between the plug and the vial body portion to render them moisture-resistant. The present invention is an improvement over the foregoing structure in that it also provides fluid tight engagement between the plug and the vial body portion to thereby render the container moisture-proof.

SUMMARY OF THE INVENTION

It is accordingly one object of the present invention to provide an improved container having a "child-resistant" safety plug locking construction and which also provides a moisture-resistant fluid tight seal between the plug and the body portion of the container.

It is another object of the present invention to provide an improved container wherein a ring, which is utilized as part of the safety locking construction, is assembled onto the body portion of the container in an extremely simple and reliable manner by a snap fit, without the use of additional fastening means, such as heat welding or sonic welding. Other objects and attendant advantages of the present invention will readily be perceived hereafter.

The present invention relates to a container construction comprising a container body portion, an open end on said body portion, a rim portion surrounding said open end, a plug, a locking ring on said rim portion, an entry portion on said plug for insertion into said rim portion, locking means effectively located between said plug and said locking ring for permitting disengagement of said plug from said locking ring only when said plug is oriented in a predetermined position relative to said locking ring, a plug engaging portion on said body portion adjacent said rim portion, and an interference fit between said entry portion and said plug engaging portion. The present invention will be more fully understood when the following portions of the specification are read in conjunction with the accompanying drawings wherein:

DESCRIPTION OF THE PREFERRED EMBODIMENT

Figure 1:
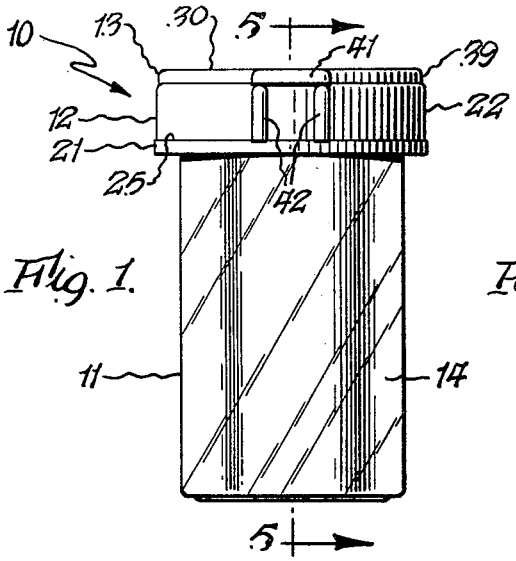
FIG. 1 is a side elevational view of the improved vial construction showing all parts thereof in assembled condition.

The improved vial construction 10 of the present invention includes a vial portion 11, a plastic ring 12 which locks onto the rim surrounding the open end of the vial body portion 11 with a snap fit, and a plug or cap 13 which is received in disengageable locking engagement with ring 12 and which also provides fluid tight engagement with vial portion 11. While the following portions of the specification will refer to a vial construction, it will be appreciated that the structural features of the vial construction are also applicable to other types of containers and it will therefore be understood that the claims, which are directed to a "container construction", are not limited to the specific vial construction which will be described in greater detail hereafter.

The vial body portion 11 is a molded plastic container having a cylindrical side wall 14 formed integrally with a bottom wall 15 and terminating at an annular rim 16 which surrounds open end 17, with rim 16 terminating at an extreme end portion 19. A first annular ridge 20 extends circumferentially about rim 16 on the outer surface of body portion 11 in spaced relationship to extreme end portion 19. A second annular ridge 21, of greater diameter than ridge 20 is located a greater distance from extreme end portion 19 than ridge 20.

A plastic ring 12 is press-fitted onto rim 16. Ring 12 includes a substantially cylindrical side portion 22 having a circumferential groove 23 therein for mating relationship with ridge 20 to assume the assembled relationship shown in FIG. 5. In this respect, the axial length of cylindrical wall 22 is such that the end 24 thereof abuts the side 25 of ridge 21 which serves the dual function of acting as a stop for end 24 and for also providing a barrier against access to end 24, to prevent prying ring 12 from assembled relationship with rim 16. Ridge 21 also serves to strengthen the vial body portion in the area in which the ridge 21 is located. At this point it is also to be noted that there is a slight interference fit between ridge 20 and groove 23 to hold ring 12 in tight assembled relationship with rim 16. By virtue of the foregoing relationship, there is no need to use additional means, such as adhesive, sonic welding, or heat welding, as additional securing means for ring 12. This is especially significant when it is considered that it is desired to fabricate ring 12 out of high density polyethylene or polypropylene which cannot be affixed to body portion 11, which is polypropylene, by the foregoing methods of attachment.

Figure 2:
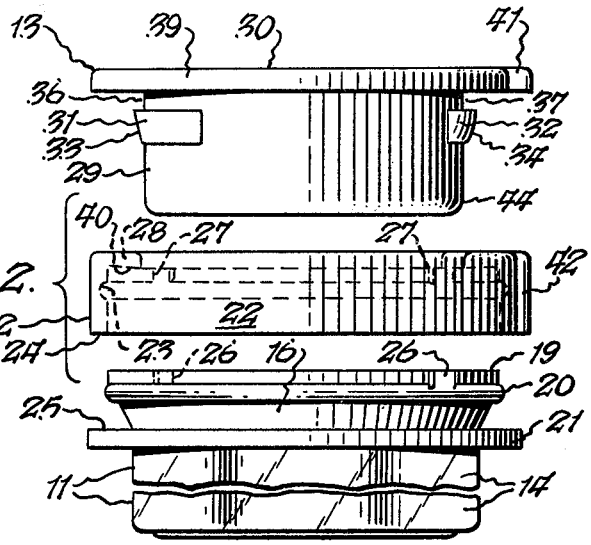
FIG. 2 is a fragmentary exploded view of the various parts of the vial construction.
Figure 3:
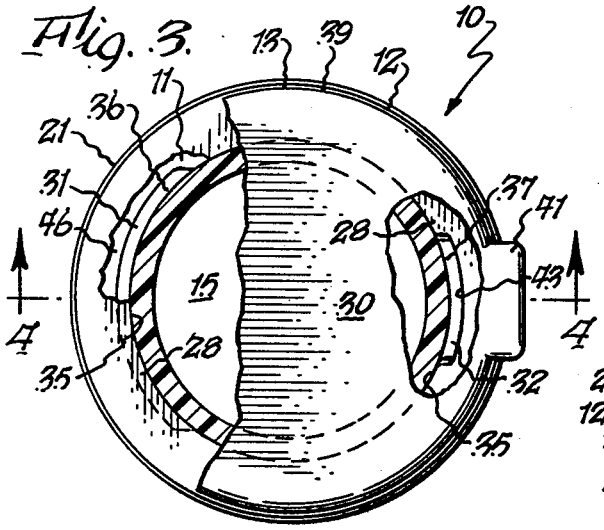
FIG. 3 is a view taken substantially along line 3—3 of FIG. 5 with certain portions being broken away to show the relationship between the various parts.
Figure 4:
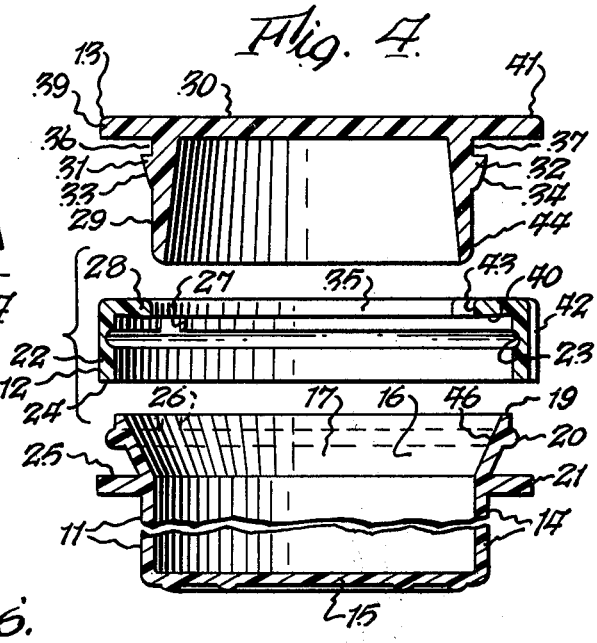
FIG. 4 is a fragmentary cross sectional exploded view of the various parts taken substantially along line 4—4 of FIG. 3.
Figure 6:
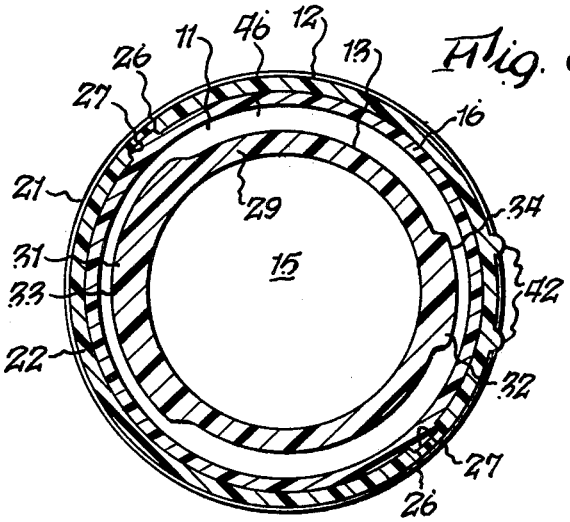
FIG. 6 is a cross sectional view taken substantially along line 6—6 of FIG. 5.

As noted above, ring 12 is press-fitted onto rim 16. However, there may be a tendency for ring 12 to rotate relative to rim 16. Accordingly, a key-keyway connection (FIG. 6) is provided between ring 12 and rim 16 to lock the two relative to each other. In this respect keys 26 are molded in diametrically opposed relationship to each other on the outside of rim 16 (FIGS. 2, 4 and 6). Keyways 27 are molded into ring 12 (FIGS. 2, 4 and 6). The keyways 27 extend between groove 23 and flange 28 which extends inwardly from cylindrical side wall 22. Therefore, in the event that ring 12 is assembled onto rim 16 without alignment between the keys 26 and the keyways 27, as will usually be the case, once there has been a circumferential twisting force applied to ring 12 which is sufficient to move it circumferentially, such movement will occur until such time as the keys 26 drop into keyways 27, and thereafter ring 12 will be held against further circumferential movement.

Figure 5:
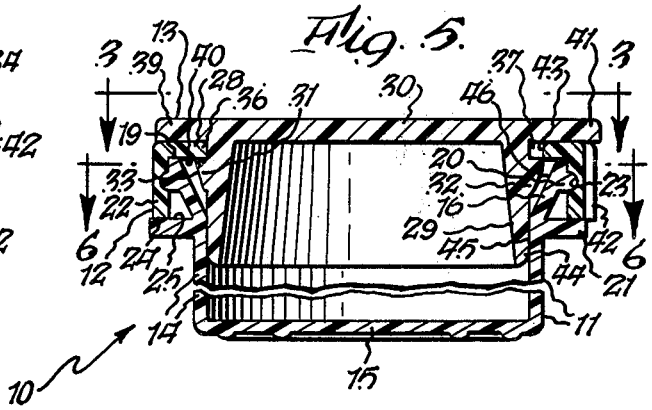
FIG. 5 is a fragmentary cross sectional view taken substantially along line 5—5 of FIG. 1 and showing the various parts in assembled relationship.

Plug 13 serves the dual function of establishing a fluid-tight relationship with container body portion 11 and also preventing removal of plug 13 unless it is circumferentially aligned in a proper manner with ring 12, the latter subject matter being shown in prior patent Nos. 3,845,874 and 3,896,958. Plug 13, which is molded from low density polyethylene, includes a substantially cylindrical entry portion 29 which is molded integrally with top 30. Cam-latch members 31 and 32 are formed integrally with entry portion 29. Cam-latch member 31 is of circumferentially larger dimension than cam-latch member 32 (FIG. 6). Member 31 includes an inclined cam surface 33 and member 32 includes an inclined cam surface 34. It can readily be seen therefore that when entry portion 29 is inserted into opening 17, there will be relative axial movement between entry portion 29 on one hand and flange 28 on the other hand. A point will be reached where inclined surfaces 33 and 34 will engage the inner edge 35 of flange 28 and as they ride past this inner edge, flange 28 and the entry portion will deflect radially relative to each other, and flange 28 will snap into position in cut-away portions 36 and 37 (FIG. 4), which are located between member 31 and cap flange 39 and between member 32 and cap flange 39, respectively. The assembled relationship is shown in FIG. 5. Normally, as a result of random insertion of plug 13 into ring 12, both members 31 and 32 will engage the underside 40 of flange 28 to hold plug 13 securely locked to ring 12, which is in turn securely locked to vial body portion 14.

As explained in detail in U.S. Pat. Nos. 3,845,874 and 3,896,958, in order to remove plug 13 from locking engagement with ring 12, it is grasped by tab 41 and rotated until tab 41 is aligned between markers 42 on ring 12. In this position smaller member 32 will be aligned with cutaway portion 43 in flange 28 to permit member 32 to be lifted through cutaway portion 43 to thus permit plug 13 to be removed from assembled relationship with ring 12 by merely lifting upwardly on tab 41. When this is done, it will be appreciated that member 31 will cant out of locking engagement with flange 28. The foregoing unlocking action is identical to that described in the above patents, and, by itself, forms no part of the present invention.

In accordance with the present invention, a fluid tight seal is provided between entry portion 29 and vial body portion 14. This fluid tight relationship causes the inside of the container to be moisture-proof to prevent deterioration of pills, capsules or the like stored within vial body portion 10. In order to achieve the fluid-tight relationship, entry portion 29 is sufficiently long so that the lower portion 44 (FIG. 5) thereof will fit into cylindrical body portion 45 immediately below rim 16. In this respect, it is to be noted that there is approximately a 0.010 to 0.015 inch interference fit between the outer diameter of plug portion 44 and the adjacent portion 45 of vial body portion 14. It is this interference fit which provides the fluid-tight relationship. Further in the foregoing respect, it is to be noted that plug 13 is fabricated from molded low density polyethylene which renders it sufficiently flexible so that it can assume the foregoing interference fit which provides the desired fluid tight relationship. It is also to be noted that the plug 13 has a certain inherent amount of lubrication to permit it to be rotated relative to body portion 14 in spite of the interference fit, so that member 32 may be aligned with cutaway 43 to permit removal of plug 30, as explained above. The flexibility of entry portion 29 is enhanced by virtue of its tapered construction as shown in cross section in FIGS. 4 and 5. In this respect, it can readily be seen that the portion of entry portion 29 adjacent to portion 30 is thicker than the portion 44 which provides the fluid tight seal. This taper enhances flexibility of entry portion 29 so that a good fluid seal is obtained.

In order to enhance the movement of entry portion 29 into fluid tight engagement with protion 45, as shown in FIG. 5, rim 16 possesses a taper (FIGS. 4 and 5) which guides lower portion 44 of entry portion 29 into the above-described fluid tight engagement. In this respect, as can be visualized from FIGS. 4 and 5, as lower portion 44 of entry portion 29 enters rim 16, the outer surface of lower portion 44 will at a certain point engage tapered surface 46 of rim 16, whereupon tapered surface 46 will act as a funnel to guide entry portion 29 into the fluid-tight position shown in FIG. 5 wherein portions 44 and 45 are in an interference fit. In the foregoing respect, it is to be noted that the diameter of entry portion 29 in the vicinity of lower portion 44 is less than the internal diameter of annular flange 28 and less than the diameter of extreme end portion 19 of rim 16 and that rim 16 tapers inwardly and meets cylindrical body portion 14 at area 45, which as noted above, is of less diameter than lower portion 44.

It is also to be noted that the outer diameter of plug portion 30 is substantially equal to the outer diameter of ring 12 except at tab 41 so that a prying force cannot be applied to flange 39 of top 30.

The drawings are drawn substantially to scale, and the actual dimension of the internal diameter of body portion 14 is approximately one inch. It will be appreciated, however, that variations may be made in the size of the various parts.

While a preferred embodiment of the present invention has been disclosed, it will be appreciated that it is not limited thereto but may be otherwise embodied within the scope of the following claims.

What is claimed is:

1. A container construction comprising a container body portion having inner and outer surfaces, an open end on said body portion, an annular rim surrounding said open end and having an inner surface and an outer surface, an extreme end portion on said annular rim, annular ridge means on said outer surface of said annular rim and spaced from said extreme end portion, a ring having an internal surface and an external surface, annular flange means on said ring for placement in contiguous relationship relative to said extreme end portion of said annular rim, and groove means on said internal surface of said ring for mating engagement with said annular ridge means with a snap fit.

2. A container construction as set forth in claim 1 including key means and keyway means between said ring and said rim for preventing relative rotation therebetween.

3. A container construction as set forth in claim 2 wherein said key means comprises protuberance means on said rim between said annular ridge means and said extreme end portion, and wherein said keyway means comprise slot means on said internal surface of said ring between said groove means and said annular flange means.

4. A container construction as set forth in claim 1 including second annular ridge means spaced a greater distance from said extreme end portion and protruding a greater radial distance from said outer surface of said rim than said annular ridge means, and an annular surface on the opposite end of said ring from said flange for substantial abutting engagement with said second annular ridge means.

5. A container construction as set forth in claim 4 wherein said annular flange is in overlying relationship to said extreme end portion of said rim, and wherein said second annular ridge means has a diameter which is substantially the same as the diameter of said outer surface of said ring to prevent access to said annular surface.

6. A container construction as set forth in claim 5 including key means and keyway means between said ring and said rim for preventing relative rotation therebetween.

7. A container construction as set forth in claim 1 wherein said inner surface of said rim includes a tapered portion extending inwardly from said extreme end portion, a plug, a generally cylindrical entry portion on said plug for passage through said annular flange means, said tapered portion serving to guide said entry portion into said container body portion, a substantially cylindrical container portion proximate said tapered portion for receiving said generally cylindrical entry portion, said substantially cylindrical container portion having a diameter which is less than the diameter of said generally cylindrical entry portion to provide an interference fit therebetween to effect sealing between said entry portion and said container body portion.

8. A container construction as set forth in claim 7 including second annular ridge means spaced a greater distance from said extreme end portion and protruding a greater radial distance from said outer surface of said rim than said annular ridge means, and an annular surface on the opposite end of said ring from said flange for abutting engagement with said second annular ridge means.

9. A container construction as set forth in claim 8 wherein said annular flange is in overlying relationship to said extreme end portion of said rim, and wherein said second annular ridge means has a diameter which is substantially the same as the diameter of said outer surface of said ring to prevent access to said annular surface.

10. A container construction as set forth in claim 9 including key means and keyway means between said ring and said rim for preventing relative rotation therebetween.

11. A container construction as set forth in claim 7 including locking means between said annular flange means and said plug.

12. A container construction as set forth in claim 11 wherein said locking means comprises cam-latch means on said plug for engaging said annular flange means, and circumferential slot means in said annular flange means for permitting passage of said cam-latch means therethrough when in alignment therewith.

13. A container construction which is child-resistant and moisture-resistant comprising a container body portion, an open end on said body portion, a rim portion surrounding said open end, a plug, a locking ring on said rim portion, an entry portion on said plug, locking means effectively located between said plug and said locking ring for permitting disengagement of said plug from said locking ring only when said plug is oriented in a predetermined position relative to said locking ring, a plug-engaging portion on said body portion adjacent said rim, and an interference fit between said entry portion and said plug-engaging portion to thereby cause said container to be moisture-resistant.

14. A container construction as set forth in claim 13 wherein said entry portion is flexible.

15. A container construction as set forth in claim 14 wherein said rim includes an internal taper to guide said entry portion into engagement with said plug engaging portion.

16. A container construction as set forth in claim 15 wherein said entry portion is of substantially hollow cylindrical configuration.

17. A moisture-resistant container construction comprising a body portion, an open end on said body portion, a rim on said body portion at said open end, said rim including a tapered internal surface tapering inwardly toward the remainder of said body portion and merging with a substantially cylindrical portion of said body portion, a plug having a substantially annular cylindrical flexible entry portion having a smaller diameter than the largest diameter of said tapered internal surface whereby said tapered internal surface guides said entry portion toward said cylindrical portion of said body portion, said diameter of said entry portion being larger than the diameter of said cylindrical portion of said body portion to thereby provide a moisture-resistant interference fit therewith.

* * * * *